United States Patent [19]

Worrix

[11] Patent Number: 4,481,387

[45] Date of Patent: Nov. 6, 1984

[54] VOLTAGE ISOLATER SWITCH WITH PIVOTED CONTACT ASSEMBLIES

[75] Inventor: Matthew L. Worrix, Sheridan, Oreg.

[73] Assignee: Siemens-Allis, Inc., Atlanta, Ga.

[21] Appl. No.: 537,706

[22] Filed: Sep. 30, 1983

[51] Int. Cl.[3] ..... H01H 31/30

[52] U.S. Cl. ..... 200/48 R; 200/48 CB; 200/282

[58] Field of Search ..... 200/48 R, 48 KB, 48 CB, 200/162, 282, 254

[56] References Cited

U.S. PATENT DOCUMENTS

| | | | |
|---|---|---|---|
| 2,579,771 | 12/1951 | Warren et al. | 200/48 R |
| 2,707,732 | 5/1955 | Ortwig | 200/48 SB |
| 2,825,774 | 3/1958 | Bridges | 200/48 SB |
| 3,210,489 | 10/1965 | Pilgrim | 200/48 R |
| 3,316,366 | 4/1967 | Siviy et al. | 200/48 R |
| 3,553,412 | 1/1971 | Kerr | 200/48 R |
| 4,191,867 | 3/1980 | Feaster | 200/291 |

FOREIGN PATENT DOCUMENTS

| | | | |
|---|---|---|---|
| 127631 | 11/1928 | Switzerland | 200/48 R |

*Primary Examiner*—John W. Shepperd

*Attorney, Agent, or Firm*—F. W. Powers; J. L. James

[57] ABSTRACT

A high voltage isolator switch of the double end break type including a central, rotatable insulator carrying a switch blade and a pair of opposed insulators bearing contact assemblies for engaging the ends of the blade. The contact assemblies include pivoted saddles mounted on cantilevered studs and detents to hold the assemblies in an open position.

5 Claims, 4 Drawing Figures

VOLTAGE ISOLATER SWITCH WITH PIVOTED CONTACT ASSEMBLIES

BACKGROUND OF THE INVENTION

The present invention relates to isolator switches of the high voltage type, and more specifically to an improved, readily manufactured contact assembly for engaging the movable parts of such a switch.

Although isolator switches are not ordinarily intended to interrupt large currents, as they are usually placed in circuit with power transmission lines they must be able to carry large currents and to sustain very high voltages. Thus the electrical characteristics of these devices are quite critical. Good conductive properties, resistance to arcing or the formation of corona, and longevity are of the utmost importance. However the mechanical attributes of the switches are of equal importance. The switches are conventionally of very large size and weight, and are often mounted high in the air. They are usually located outdoors in remote power stations and therefore must have a high degree of mechanical strength and integrity.

The large, movable operating components have to be virtually trouble-free over a long period and thus are usually of heavy construction. Often large, heavy castings and specially-made metal parts are used in order to assure the integrity of operation and electrical characteristics which are needed, while providing the needed strength and rigidity.

If cost were no object it would not be difficult to design elaborate switch mechanisms which operated in the desired manner. Of course, the absence of cost constraints does not guarantee that a design will be mechanically straightforward and trouble free. However, in recent years the need to produce cost-effective, efficient designs has become more urgent and efforts have been made to devise switch mechanisms which are better than those previously known. Nonetheless, to date many manufacturers have produced designs which are complex and costly, and which rely upon large, specially cast or machined parts for their switch mechanisms.

It is therefore an object of the present invention to provide an improved isolator switch.

It is a further object to provide an improved switch mechanism for isolator switches.

A further object is to produce a switch mechanism which does not require large, expensive castings for the saddle portions thereof.

Yet another object is to provide an improved contact assembly in a double-end break style switch.

SUMMARY OF THE INVENTION

Briefly stated, in accordance with one aspect of the invention, the foregoing objects are achieved by providing a contact assembly are formed from a bracket having an upstanding section which carries a cantilevered stud and, below the stud, a stop pin. A saddle is pivotally supported as the stud and bears adjustable stops for engaging the stop pin to limit rotation of the saddle. At either side of the saddle and extending upwardly is a a row of flexible metal shoes for encapturing a switch blade end. At least one of the shoes is provided with a downwardly-extending portion which frictionally engages the stop pin, serving as a detent to hold the saddle in position.

In one embodiment of the invention a pair of each contact assemblies is mounted on one of a pair of fixed, inclined insulators disposed at opposite sides of the central insulator for engaging the ends of a switch blade. A central, rotatable insulator carries the elongate switch blade for moving the blade ends in and out of engagement with the contact assemblies.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawing in which:

DESCRIPTION OF A PREFERRED EMBODIMENT

Figure 1:
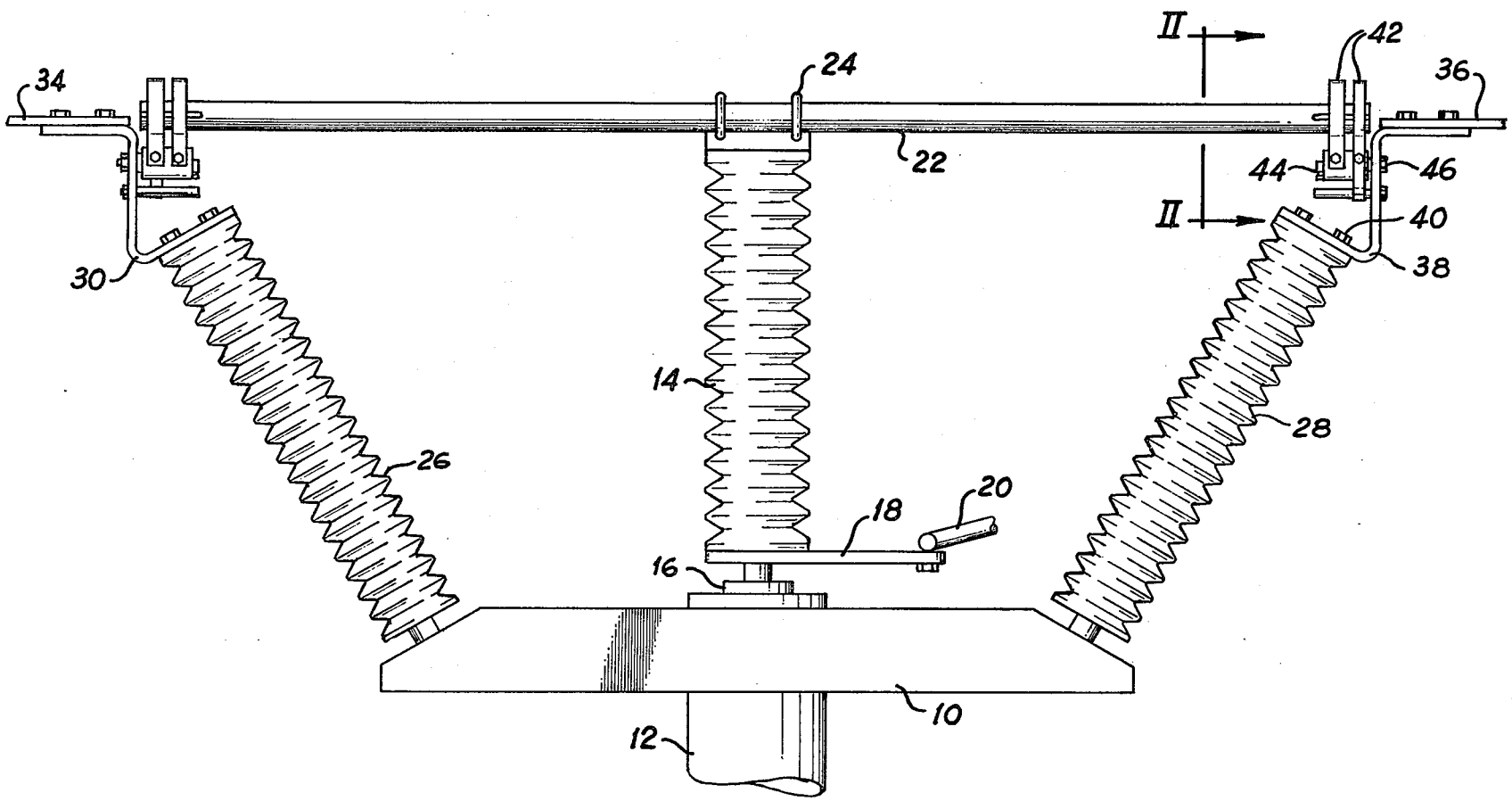
FIG. 1 is a side elevation of a double end break switch utilizing principles of the present invention.

In FIG. 1 there is shown an isolator switch including a base 10 disposed in conventional fashion upon a support column 12. A first insulator 14 is attached to the base by a rotatable support 16 and an operator arm 18 is fastened to the insulator for rotating the insulator when a pull rod 20 is moved by an actuator (not shown). Atop the first insulator 14 is a switch blade 22 coupled to the top of the insulator by means of a clamp 24. It will be recognized by those skilled in the art that while member 22 is referred to as a "blade" in practice it ordinarily is formed by a strong metal tube of copper or aluminum, frequently having specially shaped ends. Since the opposite ends of the blade engage mating contact assemblies this type of switch is referred to as a double-end break design.

A pair of stationary insulators 26 and 28 have their lower ends mounted on base 10, at opposite sides of rotatable insulator 14. The stationary insulators are mounted at an angle so that the ends of the insulators distal from the base, i.e. their upper ends, diverge.

At the upper end of each of the stationary insulators is a contact assembly, illustrated at 30 and 32. Current flows to and from the switch through conductors 34, 36 which in the illustrated embodiment take the form of bus bars.

Referring by way of example to contact assembly 32, it being recognized that assemblies 30 and 32 are identical, it will be seen that the assembly includes a bracket 38 having an angled portion fastened to the top of insulator 28 by means of bolts 40 and an upstanding portion extending upwardly from the insulator. A plurality of conductive, resilient shoes 42 encapture the end of blade 22. The shoes extend upwardly from a saddle 44 which in turn is pivotally mounted to the upstanding portion of the bracket by a pivot in the form of a special stud 46.

In operation the actuating mechanism (not shown) pushes rod 20 out of the plane of the Figure, causing the central insulator 14 to turn in a clockwise direction as seen from the top. This causes the right-hand end of blade 22 to move out from the plane of the Figure, which in turn forces the shoes of contact assembly 32 to rotate saddle 44 about the axis of pivot 46. In like manner the corresponding elements of contact assembly 30 move to allow the left-hand end of blade 22 to move in a direction into the plane of the Figure. It is this swiveling, or rotation, of the contact assemblies which allows the ends of the switch blade to be easily disengaged without the need for rotation of the blade about its own axis or other special motion of the blade which is common in such devices but which requires the presence of additional operating mechanisms, linkages, etc. which complicate the device and add to its expense.

Referring now to FIGS. *2a* and *2b*, the effect of the pivoting motion of the contact assembly 32 is apparent as are the details of the construction of the assembly. In FIG. *2a* the switch is represented in its closed position. Switch blade 22, shown in section, is firmly lodged between spring metal shoes 42. The shoes are attached at either side of saddle 44 by means of capscrews 48 which are threaded into tapped holes in the opposite sides of saddle 44. As will be explained in further detail saddle 44 is mounted to pivot about an axis 50 so that the entire assembly, including the shoes, rocks to one side to allow the exit or ingress of the end of the switch blade. A fixed stop 52, secured to the contact assembly bracket, extends below the raddle and generally parallel with axis 50. A pair of "closed" and "open" stop setscrews 54 and 56, respectively, extend from the saddle base and define the limits of travel for the socket base and attached shoes. Finally, a downwardly-depending segment of one of the shoes 42, shown herein at 58, extends near stop 52 and to one side thereof for engaging the latter upon tilting of the contact assembly. The end of segment 58 is bent at an angle to allow it to be deflected downwardly when it meets stop 52, and the portion adjacent the end frictionally engages the side of the stop.

As the switch is opened, as shown in FIG. *2b*, the switch blade is urged to the right. The force exerted by the blade against the shoes at the right-hand side of the assembly, as seen in the Figure, forces the saddle to pivot about axis 50 and in so doing allows shoes 42 to be moved out of the way of the rightwardly-moving switch blade.

The rotation of the saddle assembly continues until the "open" stop setscrew 56 abuts the stop 52. In this position the depending end 58 of one of the shoes engages stop 52 and is deflected. The frictional engagement of end 58 and the stop 52 provides a detent action so that the saddle is maintained in the position shown in FIG. *2b* after the switch blade clears the shoes. This ensures that the saddle and associated parts will remain in the correct position for receiving the end of switch blade 22 when the blade is returned to its closed position.

Figure 3:
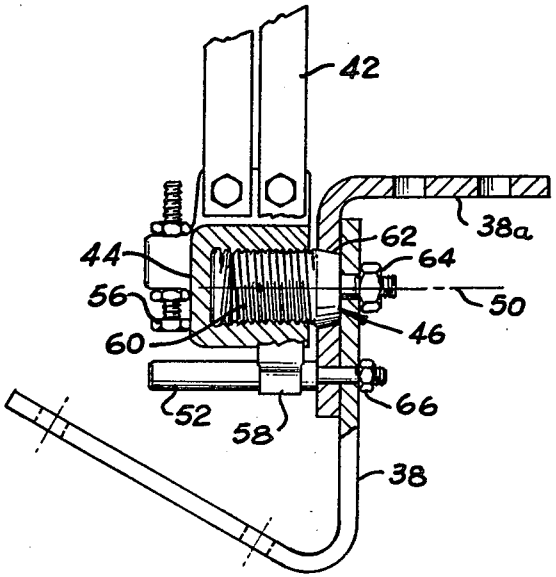
FIG. 3 is a side cutaway view of a portion of the contact assembly.
Figure 2B:
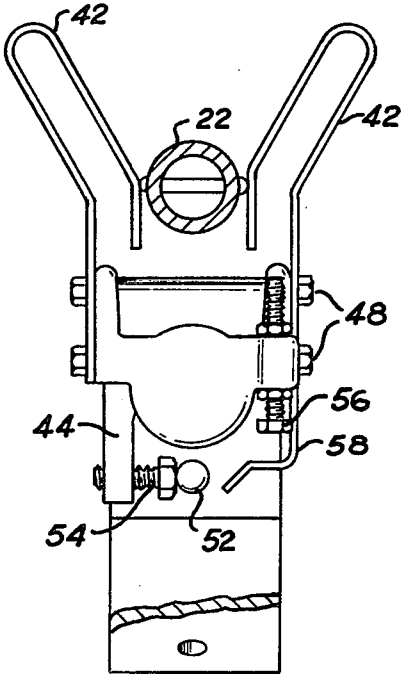
FIGS. 2*a* and 2*b* are end views of a contact assembly taken at II—II of FIG. 1.
Figure 2A:
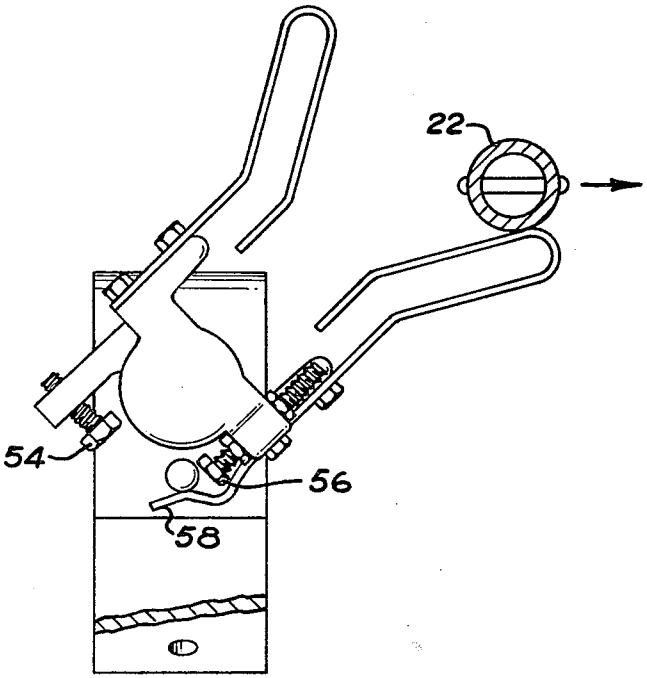

FIG. 3 illustrates further details of the construction of the contact assembly. A pivot generally indicated at 46 comprises an elongate stud including threaded barrel 60 which engages mating, female threads machined within saddle 44. By using such a threaded joint not only is the socket base captured on the stud and prevented from coming off without the need for additional keepers or the like, but also the mating surface area between the barrel and the saddle is increased very substantially. This is important since as will readily be recognized by those skilled in the art that all current carried by the switch must be conducted through this joint.

At the end of the barrel is a tapered shoulder 62 which mates with a corresponding taper in bracket extension 38*a*. Although in some applications it may be feasible to make brackets 38 and 38*a* a single piece, in the preferred embodiment two pieces of easily-fabricated flat metal are used. The overlapping of the two pieces additionally provides a double thickness of metal to produce a tapered seat for shoulder 62.

As shown, the shank of stud 46 is threaded and protrudes through the bracket, being secured by a nut 64. The inventor has found that by offsetting the axis of the shank portion slightly from the axis of rotation 50 (the axis of threaded barrel 60) the rotation of saddle 44 will not loosen nut 64. Stop 52 is comprised of a bar or the like having a threaded end which protrudes through bracket 38 in the manner shown and is secured in position by a nut 66. While the specific offset for a given application may vary, in one successfully-tested emboqiment an offset of one-sixteenth inch was utilized in combination with a $1\frac{3}{4}$ inch diameter barrel and a $\frac{5}{8}$ inch diameter shank.

It will now be seen that the applicant has provided a simple, rugged pivoting contact assembly enable in combination with a high voltage isolating switch which can be made from economically fabricated parts, and which has many fewer elements than prior art rocking-style switch mechanisms. The basic support for the contact assembly can be formed from a single piece of flat stock, and due to the cantelivered stud upon which the saddle pivots expensive bearings or trunions are rendered unnecessary.

As will be evident from the foregoing description, certain aspects of the invention are not limited to the particular details of the examples illustrated, and it is therefore contemplated that other modifications of applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. A contact assembly for engaging the movable blade of an electrical switch thereby to form a continuous electrical path through the blade and the contact assembly, comprising;

a bracket including an upstanding support portion;

pivot means having one end affixed to said support portion and extending generally perpendicular thereto;

a saddle member rotatably mounted on said pivot means;

a plurality of resilient conductive shoes affixed to opposite sides of the saddle member and extending therefrom to form an opening for receiving the movable blade; and stop means for limiting the rotation of the saddle member in a first direction in which the shoes extend in a first direction to encapture an end of the movable blade and in a second direction for allowing ingress or egress of the end of the blade, said stop means including an elongate member extending from said support portion generally parallel to said pivot, and a spring member depending from said saddle member and interfering with said stop member upon rotation of said saddle member for holding said saddle member in its rotated-to position, said spring member being an extended portion of at least one of said shoes.

2. A contact assembly according to claim 1, wherein said pivot means comprises a threaded barrel extending from said support portion and engaging a mating threaded portion in said saddle member.

3. A contact assembly according to claim 2, further including a threaded shank extending from one end of said threaded barrel and generally parallel thereto for mounting the contact assembly to a support, the axes of said threaded shank and said threaded barrel being offset from one another.

4. In a high voltage isolator switch of the double end break type comprising a base, a first, central isolator rotatably mounted on the base and upstanding therefrom; a pair of stationary insulators having lower ends mounted on opposite ends of the base and on opposite sides of said central insulator, said stationary insulators each being mounted at an angle so that the insulator upper ends distal from the base diverge; and an elongate switch blade attached to the end of the central insulator remote from said base, said blade having opposite ends which extend near the upper ends of the stationary insulator, a contact assembly mounted at the upper end of each of said stationary insulators and comprising a bracket having an angled portion attached to the insulator and a support portion upstanding generally perpendicular to the base;

pivot means coupled to the support portion and extending generally perpendicular thereto;

a saddle member rotatably mounted on said pivot means;

a plurality of resilient conductive shoes affixed to opposite sides of the saddle member and extending therefrom to form an opening for receiving an end of said switch blade; and stop means for limiting the rotation of the saddle member in a first direction in which the shoes extend upwardly away from said base to encapture an end of switch blade and in a second direction in which the shoes extend at an angle to the base for receiving said end of said switch blade;

terminal means extending from said contact assembly for receiving a conductor for carrying current to said switch; and a spring member depending from said saddle member and interfering with said stop member upon rotation of said saddle member for holding said saddle member in its rotated-to position; said spring member comprising an extended portion of at least one of said shoes.

5. The invention according to claim 4, wherein said spring member is provided with an end bent at an angle to allow it to be deflected by said stop means and an adjacent segment for frictionally engaging one side of said stop.

* * * * *